US006119929A

United States Patent [19]

Rose

[11] Patent Number: 6,119,929

[45] Date of Patent: Sep. 19, 2000

[54] CONTAINER HAVING A PLURALITY OF SELECTABLE VOLUMES

[76] Inventor: Harold J. Rose, 18 Windham Dr., Concord, N.H. 03301-5836

[21] Appl. No.: 09/039,175

[22] Filed: Mar. 13, 1998

Related U.S. Application Data

[63] Continuation-in-part of application No. 08/940,390, Sep. 30, 1997.

[51] Int. Cl.[7] ..... B65D 5/54

[52] U.S. Cl. ..... 229/101; 229/101.2; 229/236

[58] Field of Search ..... 829/101, 101.1, 829/101.2, 243, 236, 237

[56] References Cited

U.S. PATENT DOCUMENTS

| | | | |
|---|---|---|---|
| 1,125,535 | 1/1915 | Hoffman | 229/101 |
| 1,516,090 | 11/1924 | Gary et al. | 229/101 |
| 2,056,032 | 9/1936 | Berman | 229/101.1 |
| 2,210,302 | 8/1940 | Petter | 229/101.1 |
| 2,279,381 | 4/1942 | Richardson | 229/101.1 |
| 2,936,239 | 5/1960 | Rendall | 229/101 |
| 3,128,031 | 4/1964 | Dembo | 229/101.1 |
| 3,302,855 | 2/1967 | Becker | 229/101.1 |
| 3,313,467 | 4/1967 | Anderskow et al. | 229/101 |
| 3,598,303 | 8/1971 | Folz | 229/101 |
| 5,016,753 | 5/1991 | Henderson | 229/101 |
| 5,671,883 | 9/1997 | Philips | 229/236 |

*Primary Examiner*—Stephen P. Garbe
*Assistant Examiner*—Tri M. Mai
*Attorney, Agent, or Firm*—Nixon & Peabody LLP

[57] ABSTRACT

A container having a plurality of selectable volumes which selectable volumes are made by inwardly folding sides and ends of the container along selectable foldable creases. The invention may also be a container in unassembled form. Preferably the container, when assembled, is rectangular in cross sectional shape, and preferably formed from layered cardboard material. The assembled container has two side panels attached to two end panels and to the bottom portion along the panel edges thereby forming the container. There may be tearable perforations provided at the corners where the side panels join to the end panels or pairs of tearable perforations at a distance from each corner one perforation of the pair being on a side panel and the other on an end panel each substantially parallel to the corner such that the corners may be torn downward at each of the perforations or pairs of perforations to a selected set of fold facilitating creases which when folded on a selected fold facilitating crease results in the desired volume container. There is provided a plurality of sets of cooperating fold facilitating creases or scorings or other markings which make the material foldable at such markings. Each of the sets of scorings are provided on all of the side and end panels and are cooperatingly positioned so as to permit inwardly folding of the container walls and consequently enclosing a selected volume. Each of the cooperating sets of scorings may have identification markings such as colors, indicating that particular scorings belong to a particular cooperating set of scorings. The required volume is determined and the appropriate set of cooperating scorings is selected. The side walls and the end walls are appropriately inwardly folded creating thereby the enclosed volume. The number of sets of scorings depends upon material characteristics, container size and the like.

10 Claims, 3 Drawing Sheets

CONTAINER HAVING A PLURALITY OF SELECTABLE VOLUMES

This application is a continuation-in-part of pending application Ser. No. 08/940,390 filed Sep. 30, 1997.

BACKGROUND OF THE INVENTION

1. Field of the Invention

This invention most generally relates to containers. More particularly the invention relates to containers which may be folded in a manner so as to create a selected volume for the container. Most particularly, the invention relates to mailing or shipping containers made of cardboard, corrugated cardboard, boxboard or the like, which are foldably adjustable with respect to a height dimension and consequent volume in order to accommodate articles or collections of articles having a specific volume. The variable volume container thus eliminates the need for post offices and other mailing and shipping businesses to have to purchase and stock a great variety of sizes of boxes and containers. Storage of variable volume boxes is more efficient, and consumers purchasing boxes for shipping do not have to worry about or guess what size box is appropriate for their packages.

2. Description of the Prior Art

The following patents known to inventor hereof, do not in any manner suggest or teach the container having a plurality of selectable volumes as is disclosed and claimed by applicant in the instant application for patent.

U.S. Pat. No. 3,998,378 to Vetten discloses a folding box having a rectangular liquid-tight cemented bottom and is directed to a liquid-tight box of greater stability than prior art boxes. The invention also extends to a "blank" provided with appropriate score lines to form the box bottom. The patent mostly discusses how the bottom is formed by folding the various panels, and how the box is then made liquid-tight by coating with a thermoplastic adhesive. At least the end section of the box, from which the bottom is formed, is coated. The box disclosed is one size or one volume only, per individual box.

U.S. Pat. No. 4,052,932 to Huiskes discloses a folding machine for box blanks. Many box folding machines could fold side panels of box blanks, but not front and back panels. This invention is directed to a machine which can fold front and back panels. The folder requires little, if any, adjustment to accommodate and fold blanks of different sizes. The front and back panels of the blanks folded, are folded upwardly along a transverse score line in the blank, and the machine and blanks are arranged so that the forward, folded panel of the next successive blank engages the partially folded, upstanding rear panel of the first blank, to complete the folding of the first blank. The '932 patent is directed at a machine which folds boxes, and in no way discloses any type of variable volume container.

U.S. Pat. No. 4,592,464 to Londagin discloses a folding display merchandise box. The box comprises a bottom, upstanding front and rear panels, and sides which comprise the open body of the box used for holding a variety of merchandise, such as candy, electronic parts, or cosmetics. There is also a top covering for the box, provided as one piece, from the same blank, that is connected to the rear wall by a hinge. Thus, the top may be closed, or held open for display purposes. There is also provided a means for holding the top in an open, display position which defines a "display mast". The box is folded to the appropriate size and shape with the aid of score lines in the box blank. The box is scored to be folded to one size per box. Although the box is formed from the blank by the use of score lines, the Patent does not include different groups of score lines or perforations such that differently sized boxes could be made from the same box blank.

U.S. Pat. No. 4,856,709 to Axelsson et al. discloses a folding box. The primary object of the invention is directed to providing a folding box which can provide considerable saving of material, and yet still provide a sufficiently strong container, when manufacturing modern type folding boxes in that an overlapping type joint is eliminated. The box is formed with an abutting edge joint as the longitudinal joint where the body panels of the box come together to form the box. The type of box formed in this patent is referred to as a "sleeve" type. Thus, when folded initially, the box is rectangularly shaped and four sided, with open ends which may then be closed and sealed. The longitudinal joint then is the joint that runs the length of the box sleeve when the box is formed. This joint is formed when the panel edges meet edge to edge, with no overlap. The joint may then be sealed for greater stability. This Patent does not disclose or suggest the use of multiple groups of scorings or perforations, and does not disclose the making of boxes of varying volume from one blank.

U.S. Pat. No. 5,197,659 to Vassiliou discloses a disposable box by folding into a log-shaped configuration. The box disclosed contains a number of "latent score lines" in the main panels of the box, perpendicular to the length of the unfolded box. The score lines have nothing to do with the formation or use of the box and do not interfere with the formation or function of the box. The purpose of the score lines is to aid in the destruction of the box, whereby the box may be formed into a log-like structure for disposal. The invention is directed at the types of boxes that arc traditionally difficult to dispose of due to their rigidity and large flat segments, such as pizza boxes. The latent score lines arc not cut as deeply as the folding lines and thus do not affect the strength of the box when in use, and do not yield to folding pressure as easily as the primary folding lines. However, once the latent score lines have yielded, they bring about permanent damage to the integrity of the box, and the box then cannot be reused. The primary folding lines of this Patent are used to form the box into its working shape. The latent scorings are later used to roll the box into a log-like shape for disposal. There is no teaching or suggestion whatsoever in this Patent to use multiple groups of scorings to make differently-sized containers.

As seen from the above-listed patents, boxes foldable from a one-piece blank are certainly known in the art. A typical foldable box blank has primary folding lines which may be perforations, indentations, slits, scoring, cuts or any other weakening lines which provide weakening of the integrity of the unfolded box blank so that the box may be formed by folding at the weakening lines. Such foldable box blanks are usually cut or stamped from a flat sheet of, for example, cardboard. The die used to stamp the blank also scores the blank along selected lines, to enable a person to easily fold the blank along such scores to create the finished container. Some known, differently foldable containers include a typical pizza box, milk carton, and a box used to ship books. Each such pizza box and milk carton is of one size only.

There also exists a variable volume box with multiple fold lines that must be cut with a sharp blade, by an end user, before the box may be folded to accommodate smaller items. The variable volume box just described is difficult to adjust in size because it must be cut first and not many end users would be expected to typically carry, and safely and accurately handle, an exacto knife or other type of sharp blade.

The top of a milk carton is shaped differently than most storage or shipping boxes, being folded with triangularly shaped score lines to enable a spout to be formed. However, each individual milk carton may only be formed to be one size, because there is only one set of scorings at the spout portion. Also, the milk carton is designed to be left in a peaked shape when the triangular markings are folded, such that a spout is formed. The milk carton would not work as intended if the spout portion were folded to create a flat surface.

The book-shipping box known to Applicant comprises a flat rectangular bottom portion with four extending flaps which are each scored along the edge of the bottom portion and at two or three distances out from the flat bottom portion. The scoring enables the flaps to be folded up to different heights to accommodate books of different thickness. The box has no height dimension at all until it is folded around a book, and will not remain in the box shape unless scaled in place. When folded, the box also has gaps at the four corners of the container.

The primary disadvantage with most of the types of boxes discussed above, especially for those in the mailing and shipping fields, is that the box blank can form a box of only one size. Therefore, finished boxes have a fixed and predetermined volume. If a person buys a box, and it is not the right size for the item being shipped, another box must be acquired. Companies that are in the business of packaging goods and mailing and shipping of goods must stock and carry many differently sized boxes or box blanks. In addition, if a box is too big for an item and sufficient packing is not included when the item is packed, there is increased risk of damage to the item or injury to a person carrying the box or container. The item which is loose in the box may quickly shift if the box is tilted, thus possibly causing damage to the item by hitting the sides of the container, or causing damage to the item or person carrying it when the box is accidentally dropped due to the sudden, unexpected shift of weight. It would thus be desirable to have one size box blank that is able to form finished boxes having various selectable volumes, thus reducing manufacturing and storage costs, reducing inconvenience for customers attempting to select a container of proper size, and reducing damage to persons and property due to items being placed in inappropriately sized containers.

The instant invention provides many advantages over the prior art inventions noted above. It is noted that none of the prior art patented inventions relating to boxes and containers addresses the objects of the present variable volume container by providing a plurality of cooperating score or crease lines which permit the container to be folded on selected lines providing thereby, from the same container, a container volume of selected magnitude. None of the prior art inventions is as effective and as efficient as the instant container having a discrete number of volumes selectable by folding. Such containers as defined and described herein are cost effective and efficient shipping containers. It would be advantageous in the mailing and shipping industry to have a one-size box blank from which finished boxes of various volume size could be made.

SUMMARY OF THE INVENTION

The invention is directed primarily at a container having a plurality of selectable volumes which selectable volumes arc made by inwardly folding sides and ends of the container along selectable foldable creases. The invention may also be a container in unassembled form comprised of a flat blank sheet of material foldable to form walls and bottom and scribed or scored before or after assembly into the container, to provide for the selectable creasing and folding. The container may have any suitable use and particularly may be a shipping container or a storage container. Preferably the container, when assembled, is rectangular in cross sectional shape, and may be formed from cardboard, corrugated cardboard, or other suitably strong but creasable and foldable material. The container may be assembleable from a substantially flat form. In the substantially flat and unassembled form (and in the assembled form), there exist two side panels, two end panels and panels assembleable into a bottom portion. The assembled side panels are attached or are attachable to the end panels, and both side and end panels are attached or attachable to the bottom portion thereby forming the container. There may be tearable perforations provided at the corners where the side panels join to the end panels or pairs of tearable perforations at a distance from each corner one perforation of the pair being on a side panel and the other on an end panel each substantially parallel to the corner such that the corners may be torn downward at each of the perforations or pairs of perforations to a selected set of fold facilitating creases which when folded on a selected fold facilitating crease results in the desired volume container. There is provided a plurality of sets of cooperating fold facilitating creases or scorings or other markings which make the material foldable at such markings. Each of the sets of scorings are provided on all of the side and end panels and are cooperatingly positioned so as to permit inwardly folding of the container panels and consequently enclosing a selected volume. Each of the cooperating sets of scorings may have identification markings indicating that particular scorings belong to a particular cooperating set of scorings. The markings may be colors, symbols or any other suitable means of differentiation. After assembly of the container from the substantially flat and unassembled form, the required volume is determined and the appropriate set of cooperating scorings is selected. The side panels and the end panels are appropriately inwardly folded creating thereby the enclosed volume. The sets of side panel and end panel scorings are substantially horizontal. The lower-most set is positioned a distance $H_0$ from the bottom and each set is spaced by a delta H ($\Delta H$) distance from the previous set. The number of sets of scorings depends upon material characteristics, container size and the like.

In a particular embodiment of the invention where the side panels and the end panels are fixedly connected from the bottom portion to the top edges, there is provided, on each of the end panels, a plurality of sets of pairs of hypotenuse creases or scorings which cooperate with the corresponding sets of side and end panel scorings. For each of the pairs of hypotenuse creases one of the creases begins at the junction of the side and end panel scorings on one side of the end panel and the other crease of the pair begins at the junction of the side and end panel scorings on the other side of the end panel. Each hypotenuse crease of each pair has a length which is a distance of about 0.707 times the container width W and each meets the other at about ½ W or at about the centerline of the end panel—the centerline being drawn perpendicularly from the bottom. There is also a perpendicular crease on each end panel beginning at the top edge of each of the two end panels and intersecting each intersection of each pair of hypotenuse creases. There could also be tearable perforations at the corners where the side panels join to the end panels. However, in this embodiment the perforations are not to be torn down. Herein, the use of the words "wall" and "panel" may be used interchangeably where the context clearly suggests that the elements defined by the word "panel" and the word "wall" are the same elements.

The invention has the particular objectives, features and advantages of: 1) being less costly to a reseller because fewer sizes of basic container need to be retained in stock in order to accommodate many sub-sizes; 2) adjustable volume allowing container to hold items more snugly, with less internal movement, thus in some cases eliminating or at least reducing the need for additional packing material, thereby reducing shipping/packaging cost; 3) a variable volume container is advantageous for a catalog merchant who ships varied items and/or quantities in a single box; 4) the container is more environmentally friendly, by reducing the need for extra packing material; 5) less time would be spent in a shipping department figuring out what size container to use for a variety of products; 6) adjustable size is likely cheaper to ship because the appropriate smaller sizes could be selected, thus reducing space for shipping, reducing the number of parcel containers, airplanes, and trailers needed for shipping and consequently reducing the total number of miles driven, gas used, maintenance and repair costs and labor costs; 7) having filled containers ready for shipping which take up less warehouse space, thereby reducing cost; 8) saving on storage space for packing material; 9) all versions of the invention increase safety by eliminating the need to use any type of sharp blade to reduce the volume of a box; 10) Cutting down the corners of a container by hand with a sharp blade in order to reduce its volume usually produces cuts of different length and/or cuts that are not straight, resulting in a container, once it is sealed, that is uneven/asymmetrical and therefore not only unpleasing to the eye, but also difficult and unsafe to stack; 11) an embodiment of the invention with precut sealing strips increases efficiency and saves time at the Post Office, because postal clerks would no longer have to tape boxes for customers, thereby saving the Post Office labor time and cost of materials for taping, and saving time for all customers, especially those waiting in line; 12) savings in damage and replacement cost for items damaged in shipping due to internal movement of the item within a container too large for the item; 13) being available in several base adjustable sizes, and being available in heavy and light weight versions, for various goods; and 14) being more cost effective for consumers who wouldn't have to buy, along with a box, a package of packing material, and a full roll of tape or other sealing material—an appropriately sized container with just the right amount of sealing material would be available as a kit.

It is a fundamental object of the invention to provide a method for making the container having a plurality of selectable volumes. One could take an unassembled (or an assembled) corrugated cardboard box (other foldable and creasable material may be used) and while in the flat unassembled form, sets of cooperating fold facilitating creases could be put onto the side and the end panels, these creases being substantially parallel to the bottom edges of the panels. Additionally, the hypotenuse creases and the perpendicular crease on each end panel could be "scribed" onto the end panels, all done before the container is assembled or formed. When the container is to be used it would be assembled from the flat form. The particular volume desired is determined and the appropriate set of cooperating creases is used to create the desired volume. The different possible volumes would be determined by the change in the height dimension H given that the container will have a specific length L and width W. Thus a minimum volume container would have a volume determined by the product of $L \times W \times H_0$ where $H_0$ is the distance from the container bottom to the lower-most set of fold facilitating creases. Each subsequently larger volume would simply have a height dimension of $H_0 + k\Delta H$ where $k\Delta H$ is a distance above the scoring which defines $H_0$ and which distance above $H_0$ is $k\Delta H$ and is therefore determined by the particular, i.e., the kth set of scorings. Clearly it is not necessary that the incremental height dimension $\Delta H$ be the same between each set of scorings; however, it is most likely that $\Delta H$ will be substantially the same between each set of scorings. The desired volume is selected and the set of cooperating creases (the substantially parallel creases on the side panels and the end panels, the cooperating pair of hypotenuse creases on each end panel and the perpendicular crease on each end panel) are appropriately folded resulting in a closed container having the selected volume. It should be also noted that the fold facilitating creases may be "volume-determining" or "closure-assisting or a combination of both. Where the creases are used which yield volumes less than the maximum volume for the container, certain sets of creases simply assist in providing closure of the container. $H_0$wever, whether a particular set of creases is "volume-determining" or "closure-assisting or a combination is functionally a consequence of the choice of the volume for the container.

It is a further fundamental object of the invention to provide the method for making the container having a plurality of selectable volumes but where there are no hypotenuse creases and where the tearable perforations at the corners, where the side panels join to the end panels, are torn down from the top to the particular set of cooperating creases to be used for the particular chosen volume for the container.

A primary object of the invention is to provide a container having a plurality of selectable volumes, each one of the selectable volumes being a selected volume $V_k$ wherein k is an integer chosen from the group of integers 0, 1, 2, 3, . . . n−1, and wherein n is an integer defining a number of n selectable volumes, whereby choosing k equal to n−1, $V_k$ is a maximum volume $V_{n-1}$ and whereby choosing k equal to 0, $V_k$ is a minimum volume $V_0$, each of the n selectable volumes being obtainable by folding of wall means defining the container. The container comprises a bottom portion having two substantially parallel and opposing side edges each with a length dimension L and two substantially parallel and opposing end edges each with a width dimension W; two side panels each having a height dimension H defined as the distance from a side panel bottom edge to a side panel top edge, one of the two side panels is attached along the side panel bottom edge to one of the bottom portion side edges, the other of the two side panels attached along the side panel bottom edge to the other of the bottom portion side edges. Each side panel has n+1 of selectable side panel fold facilitating creases. A kth side panel fold facilitating crease is selected based upon the chosen volume $V_k$. Each of the n+1 selectable side panel creases has a length substantially equal to the length L and substantially parallel to the side panel bottom edge. There are also two end panels each having the height dimension H defined as the distance from an end panel bottom edge to an end panel top edge. One of the two end panels is attached along the end panel bottom edge to one of the bottom portion end edges and the other of the two end panels is attached along an end panel bottom edge to the other of the bottom portion end edges.

Each of the end panels has n+1 of selectable end panel fold facilitating creases. A particular or kth end panel fold facilitating crease is selected based upon the chosen volume $V_k$, i.e., the chosen volume from the selectable volumes. Each of the n+1 selectable end panel creases has a length substantially equal to the width W and substantially parallel to the end panel bottom edge. There are also n selectable pairs of hypotenuse creases on each end panel, a kth pair of hypotenuse creases being selected based upon the particular $V_k$. Each hypotenuse crease of each of the pairs of hypotenuse creases has a length substantially equal to 1.414 times the one-half W. The kth one of the selectable pairs of end panel hypotenuse creases forms at one end of each hypotenuse crease with each end of the kth end panel fold facilitating crease, about 45 degree angles and each other end of each of the pairs of hypotenuse creases, together forming about 90 degree angles. There is also a perpendicular crease on each of said end panels, beginning at the top edge of each of the two end panels and bisecting each of the 90 degree angles and terminating at a lower-most 90 degree angle defined for k equal to 0. The two side panels, the two end panels and the bottom portion are connected in a manner thereby forming the container. There arc lower-most side panel fold facilitating creases defined for k equal to 0 positioned on each of the side panels located at a lower-most crease distance of $H_0$ from each of the side panel bottom edges. A lower-most end panel fold facilitating crease is defined for k equal to 0 and is positioned on each of the end panels a lower-most crease distance of $H_0$ from each of the end panel bottom edges. Top-most side panel fold facilitating creases (which creases are volume-determining) are defined for k equal to n−1 and are positioned on each of the side panels a top-most crease distance of $H_0$ plus n−1 times an incremental H, delta H, from each of the side panel bottom edges. There are also provided top-most end panel fold facilitating creases defined for k equal to n−1 positioned on each of the end panels, a top-most crease distance of $H_0$ plus n−1 times the incremental H, said delta H, from each of the end panel bottom edges. Whereby causing folding along the kth creases cooperatively closes the container enclosing within the container the selected volume $V_k$ which volume $V_k$ would equal length L times width W times the sum of the quantity of $H_0$ and the product of k and delta H.

A further primary object of the present invention is to provide the container having a plurality of selectable volumes wherein the delta H (ΔH) is equal to the H minus the $H_0$ minus one-half W all divided by the integer n−1.

A yet further primary object of the present invention is to provide the container having a plurality of selectable volumes wherein at least one set of cooperating creases further comprise identifiable marking such as for example a color code or a symbol such as "x's", "+'s", "0's", etc. Creases with similarly identified markings or colors would be the cooperating creases which would be involved in creating a particular volume $V_k$ for the container.

A yet still further primary object of the present invention is to provide the container having a plurality of selectable volumes wherein the top edge of one of the two side panels further comprises a closure flap attached thereto.

A yet still further primary object of the present invention is to provide the container having a plurality of selectable volumes wherein the number of selectable volumes n is at least the numeral two.

An object of the invention is to provide a container having a plurality of selectable volumes, each one of the selectable volumes being a selected volume $V_k$ wherein k is an integer chosen from the group of integers 0, 1, 2, 3, . . . n−1, and wherein n is an integer defining a number of n selectable volumes, whereby choosing k equal to n−1, $V_k$ is a maximum volume $V_{n-1}$ and whereby choosing k equal to 0, $V_k$ is a minimum volume $V_0$, each of the n selectable volumes being obtainable by folding of wall means defining the container. The container comprises a bottom portion having two substantially parallel and opposing side edges each with a length dimension L and two substantially parallel and opposing end edges each with a width dimension W; two side panels each having a height dimension H defined as the distance from a side panel bottom edge to a side panel top edge, one of the two side panels is attached along the side panel bottom edge to one of the bottom portion side edges, the other of the two side panels attached along the side panel bottom edge to the other of the bottom portion side edges. Each of the side panels has n of selectable side panel fold facilitating creases. A kth side panel fold facilitating crease is selected based upon the chosen volume $V_k$. Each of the n selectable side panel creases has a length substantially equal to the length L and substantially parallel to the side panel bottom edge. Also there are two end panels each having the height dimension H defined as the distance from an end panel bottom edge to an end panel top edge. One of the two end panels is attached along the end panel bottom edge to one of the bottom portion end edges and the other of the two end panels is attached along an end panel bottom edge to the other of the bottom portion end edges. Each of the end panels has n of selectable end panel fold facilitating creases. A particular or kth end panel fold facilitating crease is selected based upon the chosen volume $V_k$, i.e., the chosen volume from the selectable volumes. Each of the n selectable end panel creases has a length substantially equal to the width W and substantially parallel to the end panel bottom edge. The two side panels, two end panels and the bottom portion connected thereby forming the container. There is a lower-most side panel fold facilitating crease defined for k equal to 0 positioned on each of the side panels a lower-most crease distance of $H_0$ from each of the side panel bottom edges. There is a lower-most end panel fold facilitating crease defined for k equal to 0 positioned on each of the end panels a lower-most crease distance of $H_0$ from each of the end panel bottom edges. There is a top-most side panel fold facilitating crease defined for k equal to n−1 positioned on each of the side panels a top-most crease distance of $H_0$ plus n−1 times an incremental H, i.e., delta H, from each of the side panel bottom edges and also a top-most end panel fold facilitating crease defined for k equal to n−1 positioned on each of the end panels a top-most crease distance of $H_0$ plus n−1 times the incremental H, said delta H, from each of the end panel bottom edges. Preferably, the location of the top-most creases will be at least ½ the width distance W down from the panel top edges permitting thereby total closure of the container when creating the maximum volume $V_k$ by folding on the top-most creases. There are n sets of cooperating creases. There is provided a means for unconnecting the two side panels from the two end panels from between at least the lowermost side panel fold facilitating creases and the lowermost end panel fold facilitating creases to about the side panel and end panel top edges. The means for unconnecting may be such as for example tearable perforations at the corners where the side panels join to the end panels.

It is a further object of the invention to provide the container having a plurality of selectable volumes further comprising side panel flaps attached along each of the side panel top edges having length substantially equal to the length L and a side panel flap width dimension substantially equal to about one-half of the width W and end panel flaps attached along each of the end panel top edges having length substantially equal to the width W and an end panel flap width dimension substantially equal to about one-half of the width W.

A further object of the present invention is to provide the container having a plurality of selectable volumes wherein the delta H (ΔH) is equal to the H minus the $H_0$ minus one-half W all divided by the integer n−1.

A yet further object of the present invention is to provide the container having a plurality of selectable volumes wherein at least one set of cooperating creases further comprise identifiable marking such as for example a color code or a symbol such as "x's", "+'s", "0's", etc. Creases with similarly identified markings or colors would be the cooperating creases which would be involved in creating a particular volume $V_k$ for the container.

A yet still further object of the present invention is to provide the container having a plurality of selectable volumes wherein the number of selectable volumes n is at least the numeral two.

It is a basic object of the invention to provide a method for creating a selected volume $V_k$ from a container having a bottom portion and having a plurality of selectable volumes, each one of the selectable volumes being a selected volume $V_k$ wherein k is an integer chosen from the group of integers 0, 1, 2, 3, . . . n−1, and wherein n is an integer defining a number of n selectable volumes, whereby choosing k equal to n−1, $V_k$ is a maximum volume $V_{n-1}$ and whereby choosing k equal to 0, $V_k$ is a minimum volume $V_0$, each of the n selectable volumes being obtainable by folding of wall means defining the container, the wall means being the bottom portion, two side panels, two end panels interconnected to thereby form the container. The method comprises the steps of: determining a minimum and a maximum volume to be created from the container; making at least one (preferably the number of selectable volumes is greater than 1, i.e., n, the number of selectable volumes is a numeral greater than one) side panel fold facilitating crease and at least one end panel fold facilitating crease at a height H from the bottom portion such that the product of the length, the width and the height H yields a selected volume of at least the minimum volume and at most the maximum volume; providing tearable interconnection which may be perforations at corners where the side panels and the end panels join, and tearing along each interconnection of the side and end panels from each corner top to the fold facilitating creases determined by the chosen volume $V_k$; and folding inwardly, at each of the selected fold facilitating creases for the side panels and the end panels, each side and end panel portion above each of the fold facilitating creases, creating thereby the selected volume $V_k$.

A further basic object of the invention is to provide a method for creating a selected volume $V_k$ from a container having a bottom portion and having a plurality of selectable volumes, each one of said selectable volumes being a selected volume $V_k$ wherein k is an integer chosen from the group of integers 0, 1, 2, 3, . . . n−1, and wherein n is an integer defining a number of n selectable volumes, whereby choosing k equal to n−1, $V_k$ is a maximum volume $V_{n-1}$ and whereby choosing k equal to 0, $V_k$ is a minimum volume $V_0$, each of the n selectable volumes being obtainable by folding of wall means defining the container, the wall means being said bottom portion, two side panels, two end panels interconnected to thereby form the container. The method comprises the steps of: determining a minimum and a maximum volume to be created from the container; making at least one side panel fold facilitating crease and at least one end panel fold facilitating crease at a height H from the bottom portion and substantially parallel to the bottom edges such that the product of the length, the width and the height H yields a selected volume of at least the minimum volume and at most the maximum volume; scoring at least one pair of hypotenuse creases, each hypotenuse crease of each said at least one pair of hypotenuse creases having a length substantially equal to 1.414 times the dimension of one-half W, forming at one end of each hypotenuse crease with each end of the at least one end panel fold facilitating crease, about a 45 degree angle and each other end of each of the at least one pair of hypotenuse creases of each pair together forming about a 90 degree angle; forming a perpendicular crease on each end panel beginning at the top edge of each of the two end panels and bisecting and terminating at the 90 degree angle and folding inwardly, at each of the selected fold facilitating creases for the side panels and the end panels, each side and end panel portion above each of the fold facilitating creases, creating thereby the selected volume $V_k$.

These and further objects of the present invention will become apparent to those skilled in the art to which this invention pertains after a study of the present disclosure of the invention.

DESCRIPTION OF THE PREFERRED EMBODIMENTS

Figure 1:
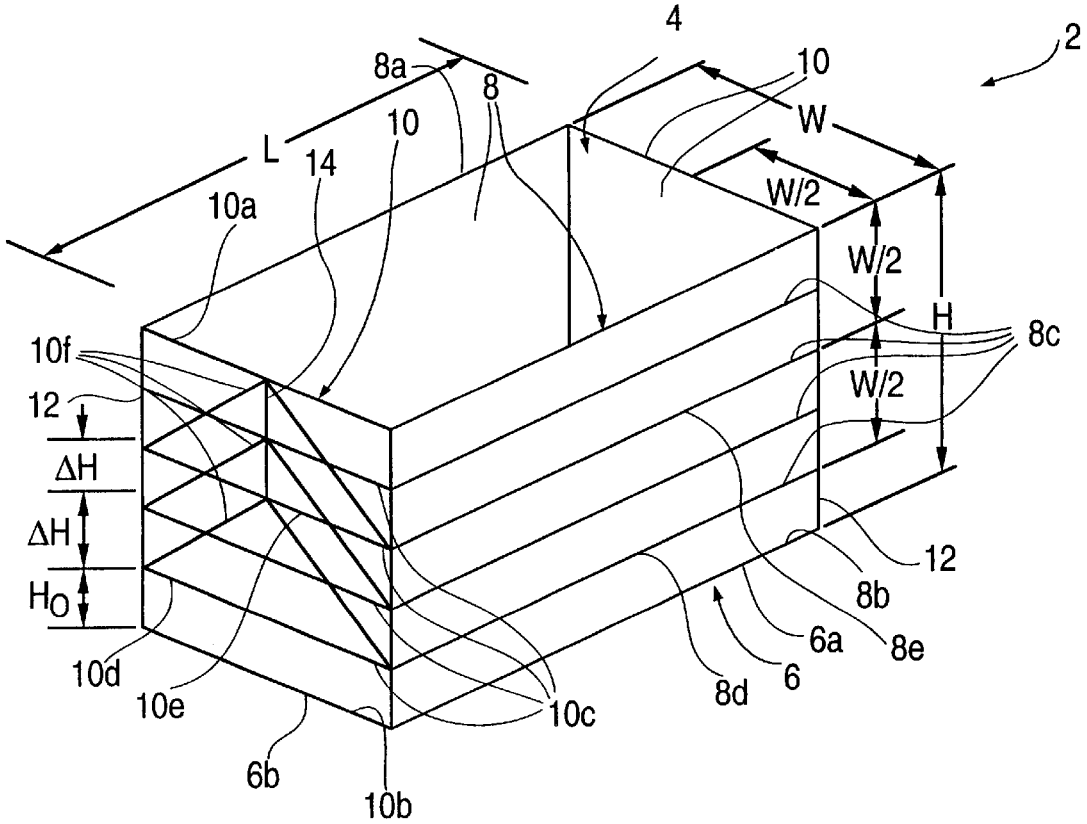
FIG. 1 is a perspective view of the container of one embodiment of the variable volume container of the present invention, showing the container in an unfolded position, with a set of cooperating fold facilitating creases formed in the container.

The following is a description of the preferred embodiments of the invention. It is clear that there may be variations in the size and the shape of the variable volume container, and in the materials used in the construction. The particular embodiments to be described in detail herein will have three selectable volumes; that is the numeral "n" which is used to identify the number of selectable volumes has the particular value of three (3). Clearly, the number of possible volumes is in part governed by materials and both a minimum and a maximum size of the containers. The value of "3" for "n" is not to be deemed as limiting; it is merely the example used in this description. Also discussed and shown in the drawing figures is the particular case where the incremental height delta H (ΔH) is substantially the same value. That is to say, that the changes in volume are incremental in that the volume height dimension increases by ΔH for each incremental volume increase. Clearly the change in height need not be in equal increments; however, most likely the container would be made in this manner. While the preferred material for the container would be cardboard or corrugated cardboard and the like, plastics or similar products which are creasable and foldable could be used.

Reference is now made to the drawings in which like numerals refer to like elements throughout the application. There are discussed basically two embodiments of the invention, container 2 sometimes referred to herein as foldable container 2, which has pairs of triangularly shaped creases, called herein hypotenuse creases 10*f* on end panels 10 schematically illustrated in FIGS. 1, 2 and 3 and there are containers 20 and 40, each sometimes referred to herein as tearable container 20 and tearable container 40, illustrated in FIGS. 4 and 5 each shown as having, in this instance, three selectable volumes and with tearable perforations 32 coincident with corners 30 where side panels 26 and end panels 28 join for container 20, and for container 40 pairs of perforations 32 each perforation 32 of the pairs of perforations being substantially parallel and spaced from corner 30 one perforation 32 of the pair being on sides 26 and the other on ends 28.

FIG. 1 shows container having a plurality of selectable volumes 2 (foldable container) with a plurality of pairs of hypotenuse creases 10*f* (in this instance three (3) pairs i.e., n=3). There is a perpendicular crease 14 on each end panel 10. Perpendicular creases 14 begin at a point located at the mid-point of the width dimension W (i.e., at ½ W) on top edges 10*a* of each end panel 10. Perpendicular creases 14 extend to the point where the lower-most pair of hypotenuse creases meet. Perpendicular creases 14 substantially bisect the 90 degree angle formed by the junction of each pair of hypotenuse creases 10*f*. There are four (4, i.e., n+1) sets of fold facilitating creases 8*c* on each of side panels 8. Each crease of each of the n+1 sets of creases is substantially parallel to side panel bottom edge 8*b*. There are four (4, i.e., n+1) sets of fold facilitating creases 10*c* on each of end panels 10. Each crease of each of the n+1 sets of creases is substantially parallel to end panel bottom edge 10*b*. Each hypotenuse crease of a pair of hypotenuse creases meets the cooperating creases 8*c* and 10*c* at one of the four corners 12 where side panel 8 meets end panel 10. The angle formed between a crease 10*c* and the intersecting hypotenuse crease is substantially about 45 degrees. I.e., the length of each hypotenuse crease is about 1.414 times one-half width dimension W. Alternately hypotenuse crease length is about 0.707 times width dimension W. Fixed dimension bottom portion 6 has parallel opposing bottom portion side edges 6*a* and parallel opposing bottom portion end edges 6*b*. Bottom portion 6 may be pre-assembled but may be assembleable from a substantially flat form. Bottom portion 6 is connected to two opposing parallel side panels 8 and two opposing parallel end panels 10 along side panel bottom edges 8*b* which have length L, and end panel bottom edges 10*b* which have width W, such that side panels 8, end panels 10 and bottom portion 6 join to form container 2 having corners 12 where side panels 8 meet end panels 10.

Open top 4 of container 2 is defined by side panel top edges 8*a* of two side panels 8 and end panel top edges 10*a* of two end panels 10. Folding of the material of each side panel 8 and each end panel 10, in a manner cooperating with the other side panel 8 and end panel 10, closes container 2 and thereby encloses a preselected volume $V_k$. Once formed to the desired volume, container 2 is sealed with a sealing material, preferably tape. Container 2, and bottom portion 6 have a fixed length dimension L, and a fixed width dimension W. Container 2 has a height dimension H determined by height dimension H of the side and end panels. For the minimum volume of container 2, side panel lower-most crease 8*d* and end panel lower-most crease 10*d* are used. Creases 8*d* and 10*d* are located a minimum volume height distance $H_0$ from bottom edges 8*b* and 10*b* respectively. For subsequently larger volumes, volume height $H_0+k\Delta H$, where k is either 1 or 2 in the instance shown in FIG. 1, determines the volume of the container; that volume height being the sum of the minimum height $H_0$ (the distance from the bottom edges 8*b* and 10*b* to the lower-most set of creases) and kΔH. Where incremental height ΔH is substantially equal between cooperating sets of creases, ΔH can be computed by taking the overall height H, subtracting $H_0$, then subtracting the quantity of one-half of the width dimension W, and dividing the result by the number of ΔH's going from the lower-most creases 8*d* and 10*d* to the upper-most or top-most volume determining fold facilitating creases 8*e* and 10*e*. In FIG. 1 there are two ΔH's i.e., for n=3 that meaning three volumes, the number of ΔH's is n−1 or in this instance two (2). In order to have complete closure of open top 4 for maximum volume $V_{n-1}$ here $V_2$, top-most volume determining fold facilitating creases 8*e* and 10*e* must be located about one-half container width W (½ W) from top edges 8*a* and 10*a*.

A closure flap 16 may be added to one of side panels 8 to facilitate more fully or more completely scaling the container.

Figure 2:
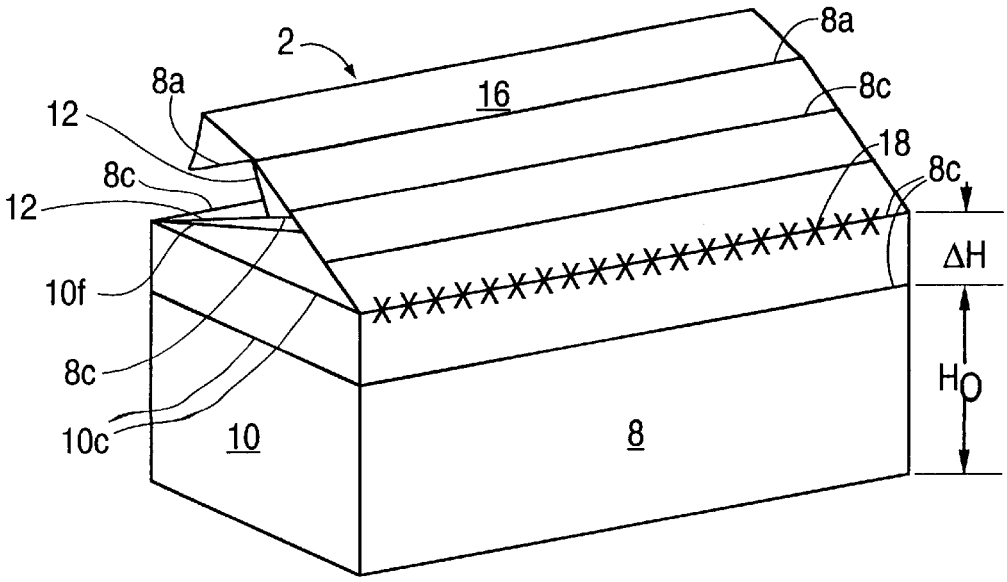
FIG. 2 is a perspective view of the embodiment shown in FIG. 1, showing a container of a particular kth volume, k=1 in this instance, partially formed wherein a particular set of cooperating fold facilitating creases is used to form a container of a particular volume. An optional closure flap is also shown.
Figure 3:
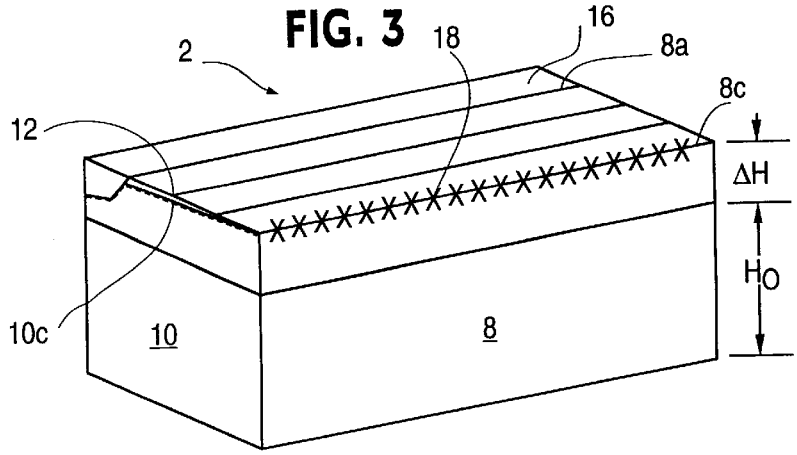
FIG. 3 is a perspective view of the embodiment of FIGS. 1 and 2 wherein a container of a particular kth volume, k=1 in this instance, has been formed and closed.

For example, in a container 2 with 3 possible volumes, such as that shown in FIGS. 1, 2, and 3, n is the numeral 3, thus k as the subscript for a selected volume $V_k$ is chosen from the values 0, 1, and 2 (i.e., 0 to n−1) for designating the three possible volumes, $V_0$, $V_1$, $V_2$. For each selection of k for a particular volume $V_k$, a kth cooperating set of side and end panel creases 8*c* and 10*c* respectively is selected or specified. While there are four (4) sets of these creases 8*c* and 10*c* there are only three (3) sets of these creases which determine volume. The fourth (4th, i.e., n+1) is required to allow folding of the panels for medium volume $V_{n-2}$. In the container 2 there are a total of n+1 of sets of cooperating side and end panel creases, or 4 total side and end panel creases for the instance of n=3 selectable volumes. For each selection of k for a particular volume $V_k$ a kth cooperating set of side and end panel creases is selected or specified. Again, while there are four (4) sets of these creases 8*c* and 10*c* there are only three (3) sets of these creases which determine volume. For designating the number of pairs of hypotenuse creases 10*f*, k is chosen from the values 0, 1, and 2, which yields n number of pairs of hypotenuse creases 10*f*, in this case, 3 pairs of hypotenuse creases.

In general, however, container 2 has a particular volume $V_k$ wherein, for a specific numeral for k, the volume $V_k$ is a selectable volume selected from a plurality of selectable volumes. The total number of possible volumes is equal to n and finite, but preferably the number of volumes n is between about two and six for a given container. The container has a maximum and a minimum volume. For k=n−1, $V_{n-1}$ is a maximum volume and for k=0, $V_0$ is a minimum volume. The k=0 side and end panel creases will be the lower-most creases 8*d* and 10*d* respectively. The k=n−1 will designate the upper-most or top-most creases 8*e* and 10*e* which creases define the maximum volume. The (n+1)th set of creases arc needed for closure of the top of the container when the volume $V_{n-2}$ is being formed. For foldable container 2 there are n+1 substantially parallel side and end panel creases. The kth panel-distance or what may be referred to as volume height is substantially about a minimum height dimension $H_0$ plus k times a delta H (ΔH) where the ΔH is a predetermined, (but each ΔH need not necessarily be equal to each other ΔH) fractional amount of the total height dimension H. The delta H is the spacing between consecutive side panel creases, and is preferably constant, making the spacing between side panel creases equal, however the spacing need not be equal. ΔH is preferably about equal to the height H minus the minimum height $H_0$ minus the distance of one-half W, the result divided by the integer n−1. For designating particular volumes the numeral k is selected from the numerals 0, 1, 2, 3, . . . , n−1. The numerical value of n, i.e., the number of possible volumes is a function of the container dimensions of length L, width W and height H and of the material composition of the container.

For k equal to n−1, which yields the maximum volume, the (n−1)th panel-distance is not greater than the height dimension H minus one-half W. If this was not the case, the top edges of the side panels would not meet when folded and the container could not be completely closed. The minimum height (i.e., for k=0) would be defined such that the top edges of the side panels, when joined by folding, would not extend beyond the opposing side of the container. However, it is possible, if a lesser minimum height was needed or desired, additional suitably placed fold facilitating creases could be positioned on the side and end panels so that the extending side panel top edges (which close the container and just meet when the container is used in the maximum volume position) could be folded over and down along the opposing side of the container. Additionally, although the example illustrated shows a container formed wherein the opposing top edges of the side panels which close the container meet each other, it is possible to "overstuff" the container, such that the side panels do not meet to fully close the container. The gap created thereby could be covered-over with suitable packaging material.

When a user of container 2 causes folding along the kth creases, all of the cooperating kth creases and the perpendicular creases result in the container closing at the open top, thereby enclosing within the container a selected volume $V_k$. The volume $V_k$ would equal the product of the length L, the width W, and the kth panel-distance, i.e., the volume height, $H_0+k\Delta H$.

FIG. 2 shows a partially folded container 2 in which a particular kth cooperating set of fold facilitating creases is chosen to form a desired volume $V_k$ for container 2. In order to form the folded container 2, a user selects the desired fold facilitating creases. Each set of cooperating fold facilitating creases may be marked with some sort of different identifiable marking such as color, or symbols, for example the X's shown as element 18. In this example, as seen in FIG. 2, container 2 is being folded to create the second volume $V_1$ (the first volume or the minimum volume being $V_0$). The side and end panels arc folded at the second set of creases and the end panels folded at the second pair of hypotenuse creases.

To fold the container, one hand is preferably placed inside container 2, along one end panel 10 of the container, and just below the second fold facilitating crease. The other hand is placed along the outside of the same end panel 10 of container 2. The outside hand then presses inwardly and downwardly at the 90 degree angle of the second set of hypotenuse creases while the inside hand supports and guides the folding. Once the first end panel 10 has begun to fold, the other end panel 10 is folded in the same manner, resulting in a partially folded container. Either side panel, if there is no closure flap, for example one side panel 8, is then folded inwardly toward the other side panel 8, which is folded inwardly and downwardly toward the first-folded side panel 8 and also folded back on itself at the fold facilitating crease positioned ½ W above the second fold facilitating crease, to lay partially underneath the first folded side panel 8, as shown in FIG. 2. Attached to side panel 8 is shown optional closure flap 16.

FIG. 3 shows container 2 in a final folded form, using optional closure flap 16 to secure container 2 in its folded form. It is important to note that when container 2 has been creased and folded to create a particular chosen volume, the container is substantially as strong and stable in volume as a box/container which does not incorporate the volume selectable features of the present container 2. In fact, when container 2 is used for less than the maximum volume, the container is stronger than conventional containers because of the overlapping at the top.

Figure 4:
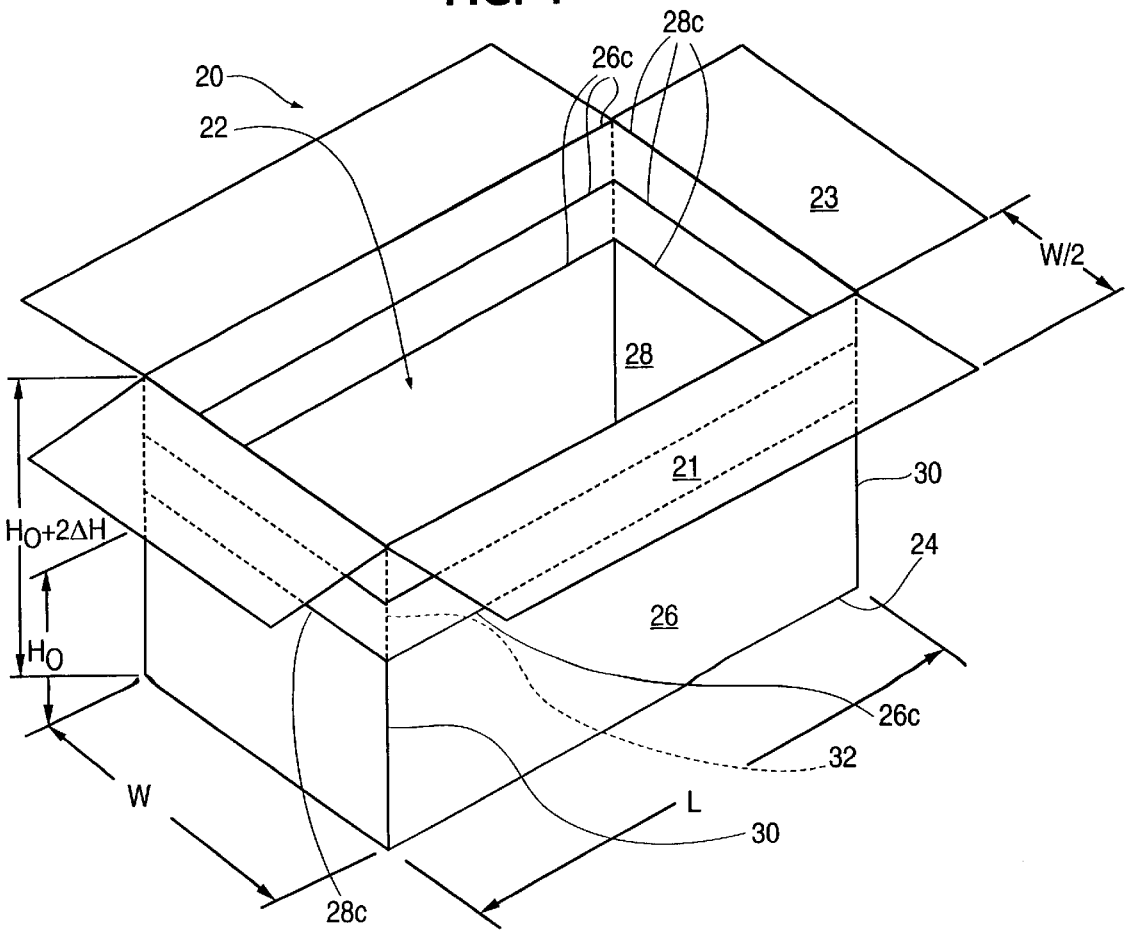
FIG. 4 shows a partially cut away perspective view of another embodiment of variable volume container having tearable perforations at each corner such that the corners may be torn downward at the perforations to a selected set of fold facilitating creases which when folded inwardly on the selected set of fold facilitating creases results in the desired volume container.
Figure 5:
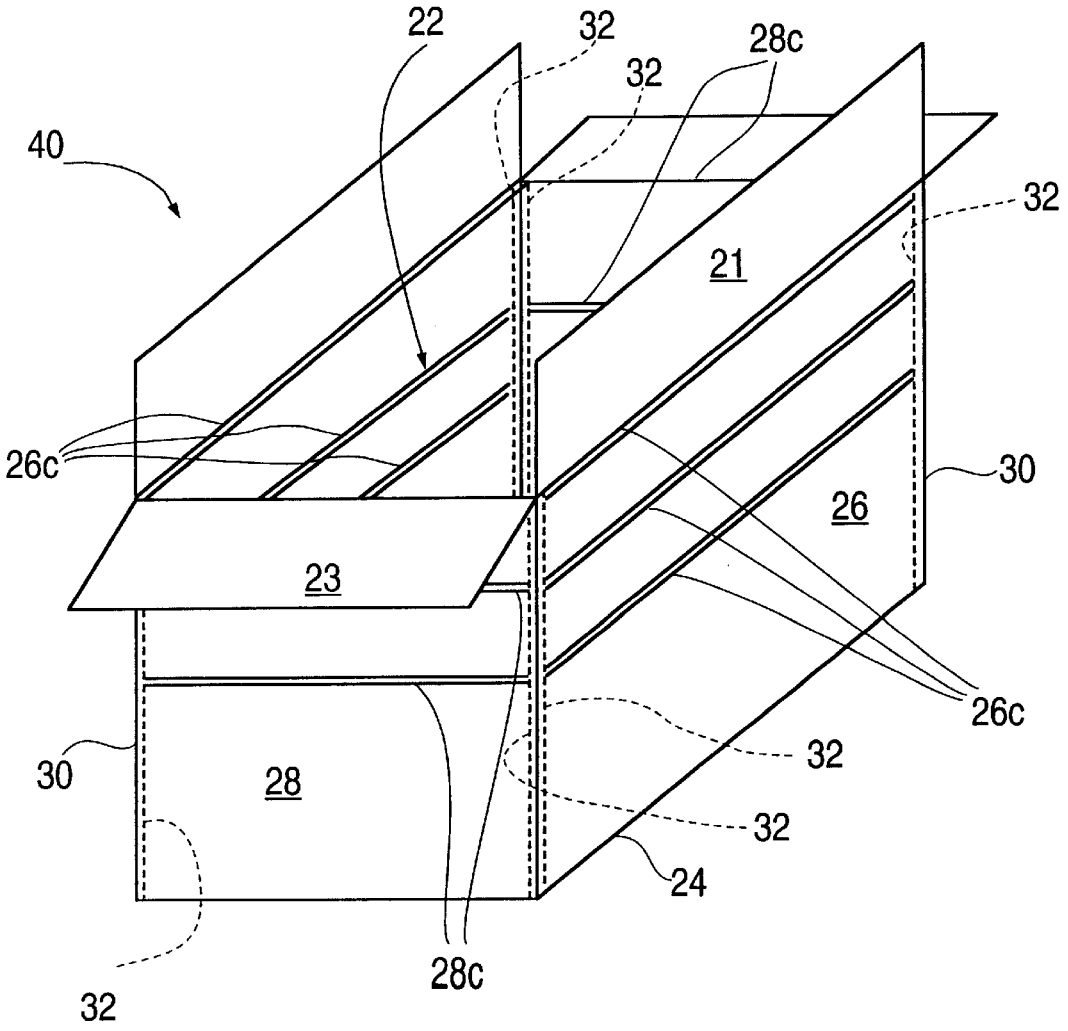
FIG. 5 shows a partially cut away perspective view of yet another embodiment of variable volume container having pairs of tearable perforations at each corner such that the corners may be torn downward at each of the pairs of perforations to a selected set of fold facilitating creases which when folded on the selected set of creases results in the desired volume container.

Another embodiment of the present invention is shown in FIGS. 4 and 5. Containers 20 and 40 each are shown having four (4) closure flaps, two (2) side panel flaps 21 and two (2) end panel flaps 23. The height dimension of the flaps, that is the distance from the top-most set of creases 26*c* and 28*c* to the top edge of the flaps is preferably not greater than ½ the width dimension W of either container 20 or container 40. This dimension limitation simply provides total closure of open top portion 22 when the maximum volume of the container is used. The maximum volume being obtained when the top-most creases arc used for closing the flaps. There are generally a plurality (n) of sets of fold facilitating creases 26*c* and 28*c* on the side panels 26 and end panels 28. In each of FIG. 4 and FIG. 5, there is illustrated the particular number of sets being three (3). If the numeral n is used to represent the number of selectable volumes for container 20 or container 40, then in the FIGS. 4 and 5 illustrated container 20 and container 40 respectively, n would equal 3 (n=3). Thus there would be three (3) selectable volumes, each of the three being denoted by $V_k$, k being an integer chosen from 0, 1, . . . n−1. Thus the minimum volume is $V_{k=0}$ or $V_0$. The maximum volume is $V_{k=(n-1)}$ or $V_{n-1}$. Thus for the case of n=3 the three selectable volumes are $V_0$, $V_1$ and $V_2$. Each of the selectable volumes would have a volume computed by the product of W times L times the sum of ($H_0+k\Delta H$). The sum ($H_0+k\Delta H$) may be considered as the volume height. Minimum height $H_0$ yields the minimum volume $V_0$. Incremental height ΔH is substantially the distance between sets of creases. Selection of the kth volume necessarily specifies the kth set of fold facilitating creases. Preferably for $V_0$, the 0th or the lower-most set of creases will be positioned down from opening 22 (e.g., down from the top edges of the flaps shown in FIGS. 4 and 5) by a distance of about container width W. Thus when flaps are created or increased in size by tearing down the perforations 32, which perforations 32 are located coincident with corners 30 for container 20 and which pairs of perforations 32 are spaced between about ⅛ inch to about ⅜ inch from corners 30 and parallel thereto for container 40, to the lower-most set of creases, the height of the flaps will be not more than container width W. However, even if the flap height is greater than W, that is the minimum volume is less, the excess flap material of the side flaps may be either cut off (or torn off if horizontally perforated) or if creases are provided the excess could easily be folded back over itself or under itself or folded over the opposite side and secured appropriately. Of course the underneath flap would have to be cut off (or torn off if horizontally perforated) or otherwise folded back over itself or under itself or tucked in.

Clearly, there may be theoretically any number of volumes but the number of volumes, i.e., the value of n will be a reasonable finite number such as an integer greater than one (1) but less than perhaps seven (7). Perforations 32, i.e., a means for permitting the tearing from at least between the top-most crease and the lower-most crease, is provided at the four corners 30 where side and end panels join for container 20 and is also provided on container 40, as pairs of perforations 32 each perforation 32 of the pairs of perforations being substantially parallel and spaced from corner 30 one perforation 32 of the pair being on sides 26 and the other on ends 28. It is also within the scope of the invention to have perforations which extend from bottom portion 24 which has a length of L and a width of W to open top 22 (with flaps omitted) of container 20 or container 40. Flaps would then be created by tearing down perforations 32 from open top 22 to the set of creases selected based upon the selected volume. The top-most set of creases would be a distance from open top 22 not less than ½ of W so as to permit complete closure of open top 22. However, in the event the distance from the top-most crease to the open top 22 is less than ½ W, a cover panel of sorts could be placed over open top 22 to cover the gap thereby created. H—the container height is the distance from the container bottom to the top edge of the created flap.

The method for making container 2 and for forming a selected volume for container 2 comprises the steps of taking an unassembled (or an assembled) corrugated cardboard box (other foldable and creasable material may be used) and while in the flat unassembled form, sets of cooperating fold facilitating creases could be put onto the side and the end panels, these creases being substantially parallel to the bottom edges of the panels. Additionally, the hypotenuse creases and the perpendicular crease on each end panel could be "scribed" onto the end panels all done before the container is assembled or formed. When the container is to be used it would be assembled from the flat form. The particular volume desired is determined and the appropriate set of cooperating creases is used to create the desired volume. The different possible volumes would be determined by the change in the height dimension H given that the container will have a specific length L and width W. The desired volume is selected and the set of cooperating creases, the substantially parallel creases on the side panels and the end panels, and the cooperating hypotenuse creases i.e., the cooperating hypotenuse crease pair on each end panel and the perpendicular crease on each end panel, are appropriately folded resulting in a closed container having the selected volume.

For the embodiment of container 20, having means for facilitating tearing (such as perforations) along the four container corners 30 from the open top 22 to the selected kth crease, the method comprises perforating at the four corners, tearing to the kth crease and causing folding along the kth creases thereby cooperatively closing the open top and enclosing within container 20 a volume $V_k$. The volume $V_k$ would equal length L times width W times the kth panel-distance (the variable height H distance).

For the embodiment of container 40, having means for facilitating tearing (such as perforations) along the four container corners 30 from the open top 22 to the selected kth crease, the method comprises perforating at the four corners with pairs of perforations 32 between about ⅛ inch and about ⅜ inch from each of corners 30 and paralleling corners 30, tearing to the kth crease and causing folding along the kth creases thereby cooperatively closing the open top and enclosing within container 40 a volume $V_k$. The volume $V_k$ would equal length L times width W times the kth panel-distance (the variable height H distance).

With either method of creating a container of selected volume, there could also be a closure flap attached to the top edge of one of the two side panels in either the embodiment of container 2 or container 20 or container 40. There would then be an additional method step after the container is closed wherein the closure flap would be secured to permit or assure an overlap when the container has the maximum volume $V_{n-1}$. It is also possible to use the closure flap to cover a gap left if the container were formed at the nth fold facilitating creases such that none of the panels would meet.

Although not shown, the present invention could also be embodied in a kit for forming a container of selectable variable volume comprising an unmarked container blank, means for marking the container blank, instructions for marking the container blank such that a container of discrete variable volume is made by folding the container blank according to markings or fold facilitating creases made following the instructions, and possibly lengths of precut tape to secure the folded container in a particular discrete volume. The means for marking which might be included in the kit could be a knife edge such as a knife or razor blade, wherein markings would be cut into the container blank, or simply a hard straight edge wherein markings or creases would be pressed into the container blank. The kit could also include a template and/or stencil for drawing or otherwise marking fold facilitating creases and possibly the template would have hard, straight edges of appropriate, differing lengths. The container blank would be cut or creased according to the instructions, thereby forming lines, scorings, cuts, or creases such that the container blank would be foldable along the cut or creased lines, into a container of a particular volume. Thus such a kit may include, along with the container blank, tape or tape and templates or templates alone. Any combination of elements could be considered as a kit.

The marking may comprise cutting into the container blank according to the instructions, thereby forming cut or score lines such that the container blank may be folded along the cut or score lines, into a container of a particular volume. The marking may also comprise pressing creases into the container blank according to the instructions, thereby forming crease, or fold lines, wherein the material of the container is not actually cut or pierced, such that the container blank may be folded along the crease or fold lines into a container of particular volume. Additionally the marking may comprise tearably perforating the container blank according to the instructions such that the container blank may be torn to an appropriate height and then folded into a container of a particular volume.

Also not shown are variations of both creased container 2 and perforated container 20. It is possible to have a container with a combination of both creases and perforations. It is also within the scope of the invention to provide for cooperating sets of creases and/or perforations extending downwards from the top portion as previously described, but also extending upwards from the bottom portion to give even more flexibility in selecting a volume size. For example, there could be a container similar to container 2 wherein the bottom would not be already sealed, and wherein the container would have creases towards the top portion like container 2, and perforations towards the bottom portion, such that the bottom could be torn to the desired distance, then sealed and then the top folded, thus adding to the number of possible volumes provided by the container. There could of course be containers combining two groups of creases, top and bottom, or two groups of perforations, top and bottom.

In another embodiment there could be included possibly, but not necessarily, preattached padding as an additional clement of the present invention, wherein padding is attached to the container. Also possible is molded foam padding, preferably with inter-meshing raised and lowered portions. The inter-meshing portions arc desirable so that when shipped empty in quantity and stored, the unassembled containers would take up as little space as possible, yet when assembled would provide protection for the items shipped. In this way also, time and expense would be saved by a customer trying to safely pack and ship a delicate item. The appropriate padding would be included with the container. Padding could be pre-attached or simply included loose as part of a kit.

It is thought that the present container having discrete foldable variable volumes, for use in the package shipping and mailing industry, and many of its attendant advantages is understood from the foregoing description and it will be apparent that various changes may be made in the form, construction and arrangement of the parts thereof without departing from the spirit and scope of the invention or sacrificing any of its material advantages, the forms hereinbefore described being not limiting but merely preferred or exemplary embodiments.

I claim:

1. A container having a plurality of selectable volumes, said plurality of selectable volumes each having a volume value of $V_k$, wherein k is an integer chosen from the group of integers 0,1,2,3, . . . n−1, and wherein n is an integer defining a predetermined number of n selectable volumes for said container, whereby choosing k equal to n−1, $V_k$ is a maximum volume value $V_{n-1}$ and whereby choosing k equal to 0, $V_k$ is a minimum volume value $V_0$, each of said n selectable volumes being obtainable by folding of wall means defining said container, said container comprising:

a bottom portion having two substantially parallel and opposing side edges each with a length dimension L and two substantially parallel and opposing end edges each with a width dimension W;

two side panels each having a height dimension H defined at side panel top edges, one of said two side panels attached along a side panel bottom edge to one of said bottom portion side edges, the other of said two side panels attached along a side panel bottom edge to the other of said bottom portion side edges, each of said side panels having n selectable side panel fold facilitating creases, a kth side panel fold facilitating crease being selected based upon said $V_k$, each of said n selectable side panel creases having a length substantially equal to said length L and substantially parallel to said side panel bottom edge;

two end panels each having said height dimension H defined at end panel top edges, one of said two end panels attached along an end panel bottom edge to one of said bottom portion end edges, the other of said two end panels attached along an end panel bottom edge to the other of said bottom portion end edges, each of said end panels having n selectable end panel fold facilitating creases, a kth end panel fold facilitating crease being selected based upon said $V_k$, each of said n selectable end panel creases having a length substantially equal to said width W and substantially parallel to said end panel bottom edge;

said two side panels, said two end panels and said bottom portion connected thereby forming said container;

lower-most side panel fold facilitating creases defined for k equal to 0 positioned on each of said side panels a lower-most crease distance of $H_0$ from each of said side panel bottom edges;

lower-most end panel fold facilitating creases defined for k equal to 0 positioned on each of said end panels a lower-most crease distance of $H_0$ from each of said end panel bottom edges;

top-most side panel fold facilitating creases defined for k equal to n−1 positioned on each of said side panels at top-most crease distance of $H_0$ plus n−1 times an incremental H, delta H, from each of said side panel bottom edges;

top-most end panel fold facilitating creases defined for k equal to n−1 positioned on each of said end panels a top-most crease distance of $H_0$ plus n−1 times said incremental H, said delta H, from each of said end panel bottom edges; and means for unconnecting said two side panels from said two end panels between at least said lowermost side panel fold facilitating creases and said lowermost end panel fold facilitating creases to about said side panel top edges and said end panel top edges;

wherein said means for unconnecting comprises a pair of perforations;

wherein said pair of perforations comprises a first set of perforations and a second set of perforations, said first set spaced between about ⅛ inch to about ⅜ inch from corners and substantially parallel with said corners on said end panel and said second set of perforations between about ⅛ inch to about ⅜ inch from said corners and substantially parallel with said corners on said side panel, said corners formed where said side panels meet said end panels.

2. A container having a plurality of selectable volumes, said plurality of selectable volumes each having a volume value of $V_k$, wherein k is an integer chosen from the group of integers 0,1,2,3, . . . n−1, and wherein n is an integer defining a predetermined number of n selectable volumes for said container, whereby choosing k equal to n−1, $V_k$ is a maximum volume value $V_{n-1}$ and whereby choosing k equal to 0, $V_k$ is a minimum volume value $V_0$, each of said n selectable volumes being obtainable by folding of wall means defining said container, said container comprising:

a bottom portion having two substantially parallel and opposing side edges each with a length dimension L and two substantially parallel and opposing end edges each with a width dimension W;

two side panels each having a height dimension H defined at side panel top edges, one of said two side panels attached along a side panel bottom edge to one of said bottom portion side edges, the other of said two side panels attached along a side panel bottom edge to the other of said bottom portion side edges, each of said side panels having n selectable side panel fold facilitating creases, a kth side panel fold facilitating crease being selected based upon said $V_k$, each of said n selectable side panel creases having a length substantially equal to said length L and substantially parallel to said side panel bottom edge;

two end panels each having said height dimension H defined at end panel top edges, one of said two end panels attached along an end panel bottom edge to one of said bottom portion end edges, the other of said two end panels attached along an end panel bottom edge to the other of said bottom portion end edges, each of said end panels having n selectable end panel fold facilitating creases, a kth end panel fold facilitating crease being selected based upon said $V_k$, each of said n selectable end panel creases having a length substantially equal to said width W and substantially parallel to said end panel bottom edge;

said two side panels, said two end panels and said bottom portion connected thereby forming said container;

lower-most side panel fold facilitating creases defined for k equal to 0 positioned on each of said side panels a lower-most crease distance of $H_0$ from each of said side panel bottom edges;

lower-most end panel fold facilitating creases defined for k equal to 0 positioned on each of said end panels a lower-most crease distance of $H_0$ from each of said end panel bottom edges;

top-most side panel fold facilitating creases defined for k equal to n−1 positioned on each of said side panels at top-most crease distance of $H_0$ plus n−1 times an incremental H, delta H, from each of said side panel bottom edges;

top-most end panel fold facilitating creases defined for k equal to n−1 positioned on each of said end panels a top-most crease distance of $H_0$ plus n−1 times said incremental H, said delta H, from each of said end panel bottom edges; and means for unconnecting said two side panels from said two end panels between at least said lowermost side panel fold facilitating creases and said lowermost end panel fold facilitating creases to about said side panel top edges and said end panel top edges;

said container further comprising:

side panel flaps attached along each of said side panel top edges having length substantially equal to said length L and a side panel flap width dimension substantially equal to not less than about one-half of said width W;

end panel flaps attached along each of said end panel top edges having length substantially equal to said width W and end panel flap width dimension substantially equal to not less than about one-half of said width W;

wherein said means for unconnecting comprises a pair of perforations;

wherein said pair of perforations comprises a first set of perforations and a second set of perforations, said first set spaced between about ⅛ inch to about ⅜ inch from corners and substantially parallel with said corners on said end panel and said second set of perforations between about ⅛ inch to about ⅜ inch from said corners and substantially parallel with said corners on said side panel, said corners formed where said side panels meet said end panels.

3. A container having a plurality of selectable volumes, said plurality of selectable volumes each having a volume value of $V_k$, wherein k is an integer chosen from the group of integers 0,1,2,3, . . . n−1, and wherein n is an integer defining a predetermined number of n selectable volumes for said container, whereby choosing k equal to n−1, $V_k$ is a maximum volume value $V_{n-1}$ and whereby choosing k equal to 0, $V_k$ is a minimum volume value $V_0$, each of said n selectable volumes being obtainable by folding of wall means defining said container, said container comprising:

a bottom portion having two substantially parallel and opposing side edges each with a length dimension L and two substantially parallel and opposing end edges each with a width dimension W;

two side panels each having a height dimension H defined at side panel top edges, one of said two side panels attached along a side panel bottom edge to one of said bottom portion side edges, the other of said two side panels attached along a side panel bottom edge to the other of said bottom portion side edges, each of said side panels having n selectable side panel fold facilitating creases, a kth side panel fold facilitating crease being selected based upon said $V_k$, each of said n selectable side panel creases having a length substantially equal to said length L and substantially parallel to said side panel bottom edge;

two end panels each having said height dimension H defined at end panel top edges, one of said two end panels attached along an end panel bottom edge to one of said bottom portion end edges, the other of said two end panels attached along an end panel bottom edge to the other of said bottom portion end edges, each of said end panels having n selectable end panel fold facilitating creases, a kth end panel fold facilitating crease being selected based upon said $V_k$, each of said n selectable end panel creases having a length substantially equal to said width W and substantially parallel to said end panel bottom edge;

said two side panels, said two end panels and said bottom portion connected thereby fanning said container;

lower-most side panel fold facilitating creases defined for k equal to 0 positioned on each of said side panels a lower-most crease distance of $H_0$ from each of said side panel bottom edges;

lower-most end panel fold facilitating creases defined for k equal to 0 positioned on each of said end panels a lower-most crease distance of $H_0$ from each of said end panel bottom edges;

top-most side panel fold facilitating creases defined for k equal to n−1 positioned on each of said side panels at top-most crease distance of $H_0$ plus n−1 times an incremental H, delta H, from each of said side panel bottom edges;

top-most end panel fold facilitating creases defined for k equal to n−1 positioned on each of said end panels a top-most crease distance of $H_0$ plus n−1 times said incremental H, said delta H, from each of said end panel bottom edges; and means for unconnecting said two side panels from said two end panels between at least said lowermost side panel fold facilitating creases and said lowermost end panel fold facilitating creases to about said side panel top edges and said end panel top edges;

wherein said delta H is equal to said H minus said $H_0$ minus ½W all divided by said integer n−1;

wherein said means for unconnecting comprises a pair of perforations;

wherein said pair of perforations comprises a first set of perforations and a second set of perforations, said first set spaced between about ⅛ inch to about ⅜ inch from corners and substantially parallel with said corners on said end panel and said second set of perforations between about ⅛ inch to about ⅜ inch from said corners and substantially parallel with said corners on said side panel, said corners formed where said side panels meet said end panels.

4. A container having a plurality of selectable volumes, said plurality of selectable volumes each having a volume value of $V_k$, wherein k is an integer chosen from the group of integers 0,1,2,3, . . . n−1, and wherein n is an integer defining a predetermined number of n selectable volumes for said container, whereby choosing k equal to n−1, $V_k$ is a maximum volume value $V_{-1}$ and whereby choosing k equal to 0, $V_k$ is a minimum volume value $V_0$, each of said n selectable volumes being obtainable by folding of wall means defining said container, said container comprising:

a bottom portion having two substantially parallel and opposing side edges each with a length dimension L and two substantially parallel and opposing end edges each with a width dimension W;

two side panels each having a height dimension H defined at side panel top edges, one of said two side panels attached along a side panel bottom edge to one of said bottom portion side edges, the other of said two side panels attached along a side panel bottom edge to the other of said bottom portion side edges, each of said side panels having n selectable side panel fold facilitating creases, a kth side panel fold facilitating crease being selected based upon said $V_k$, each of said n selectable side panel creases having a length substantially equal to said length L and substantially parallel to said side panel bottom edge;

two end panels each having said height dimension H defined at end panel top edges, one of said two end panels attached along an end panel bottom edge to one of said bottom portion end edges, the other of said two end panels attached along an end panel bottom edge to the other of said bottom portion end edges, each of said end panels having n selectable end panel fold facilitating creases, a kth end panel fold facilitating crease being selected based upon said $V_k$, each of said n selectable end panel creases having a length substantially equal to said width W and substantially parallel to said end panel bottom edge;

said two side panels, said two end panels and said bottom portion connected thereby forming said container;

lower-most side panel fold facilitating creases defined for k equal to 0 positioned on each of said side panels a lower-most crease distance of $H_0$ from each of said side panel bottom edges;

lower-most end panel fold facilitating creases defined for k equal to 0 positioned on each of said end panels a lower-most crease distance of $H_0$ from each of said end panel bottom edges;

top-most side panel fold facilitating creases defined for k equal to n−1 positioned on each of said side panels at top-most crease distance of $H_0$ plus n−1 times an incremental H, delta H, from each of said side panel bottom edges;

top-most end panel fold facilitating creases defined for k equal to n−1 positioned on each of said end panels a top-most crease distance of $H_0$ plus n−1 times said incremental H, said delta H, from each of said end panel bottom edges; and means for unconnecting said two side panels from said two end panels between at least said lowermost side panel fold facilitating creases and said lowermost end panel fold facilitating creases to about said side panel top edges and said end panel top edges;

said container further comprising:

side panel flaps attached along each of said side panel top edges having length substantially equal to said length L and a side panel flap width dimension substantially equal to not less than about one-half of said width W;

end panel flaps attached along each of said end panel top edges having length substantially equal to said width W and end panel flap width dimension substantially equal to not less than about one-half of said width W;

wherein said delta H is equal to said H minus said $H_0$ all divided by said integer n−1;

wherein said means for unconnecting comprises a pair of perforations;

wherein said pair of perforations comprises a first set of perforations and a second set of perforations, said first set spaced between about ⅛ inch to about ⅜ inch from corners and substantially parallel with said corners on said end panel and said second set of perforations between about ⅛ inch to about ⅜ inch from said corners and substantially parallel with said corners on said side panel, said corners formed where said side panels meet said end panels.

5. A container having a plurality of selectable volumes, said plurality of selectable volumes each having a volume value of $V_k$, wherein k is an integer chosen from the group of integers 0,1,2,3, . . . n−1, and wherein n is an integer defining a predetermined number of n selectable volumes for said container, whereby choosing k equal to n−1, $V_k$ is a maximum volume value $V_{n-1}$ and whereby choosing k equal to 0, $V_k$ is a minimum volume value $V_0$, each of said n selectable volumes being obtainable by folding of wall means defining said container, said container comprising:

a bottom portion having two substantially parallel and opposing side edges each with a length dimension L and two substantially parallel and opposing end edges each with a width dimension W;

two side panels each having a height dimension H defined at side panel top edges, one of said two side panels attached along a side panel bottom edge to one of said bottom portion side edges, the other of said two side panels attached along a side panel bottom edge to the other of said bottom portion side edges, each of said side panels having n selectable side panel fold facilitating creases, a kth side panel fold facilitating crease being selected based upon said $V_k$, each of said n selectable side panel creases having a length substantially equal to said length L and substantially parallel to said side panel bottom edge;

two end panels each having said height dimension H defined at end panel top edges, one of said two end panels attached along an end panel bottom edge to one of said bottom portion end edges, the other of said two end panels attached along an end panel bottom edge to the other of said bottom portion end edges, each of said end panels having n selectable end panel fold facilitating creases, a kth end panel fold facilitating crease being selected based upon said $V_k$, each of said n selectable end panel creases having a length substantially equal to said width W and substantially parallel to said end panel bottom edge;

said two side panels, said two end panels and said bottom portion connected thereby forming said container;

lower-most side panel fold facilitating creases defined for k equal to 0 positioned on each of said side panels a lower-most crease distance of $H_0$ from each of said side panel bottom edges;

lower-most end panel fold facilitating creases defined for k equal to 0 positioned on each of said end panels a lower-most crease distance of $H_0$ from each of said end panel bottom edges;

top-most side panel fold facilitating creases defined for k equal to n−1 positioned on each of said side panels at top-most crease distance of $H_0$ plus n−1 times an incremental H, delta H, from each of said side panel bottom edges;

top-most end panel fold facilitating creases defined for k equal to n−1 positioned on each of said end panels a top-most crease distance of $H_0$ plus n−1 times said incremental H, said delta H, from each of said end panel bottom edges; and means for unconnecting said two side panels from said two end panels between at least said lowermost side panel fold facilitating creases and said lowermost end panel fold facilitating creases to about said side panel top edges and said end panel top edges;

said container further comprising:

side panel flaps attached along each of said side panel top edges having length substantially equal to said length L and a side panel flap width dimension substantially equal to not less than about one-half of said width W;

end panel flaps attached along each of said end panel top edges having length substantially equal to said width W and end panel flap width dimension substantially equal to not less than about one-half of said width W;

wherein said delta H is equal to said H minus said $H_0$ all divided by integer n−1;

wherein at least one set of each of said kth creases further comprise identifiable marking;

wherein said means for unconnecting comprises a pair of perforations;

wherein said pair of perforations comprises a first set of perforations and a second set of perforations, said first set spaced between about ⅛ inch to about ⅜ inch from corners and substantially parallel with said corners on said end panel and said second set of perforations between about ⅛ inch to about ⅜ inch from said corners and substantially parallel with said corners on said side panel, said corners formed where said side panels meet said end panels.

6. A container having a plurality of selectable volumes, each one of said selectable volumes being a selected volume $V_k$ wherein k is an integer chosen from the group of integers 0, 1, 2, 3, . . . n−1, and wherein n is an integer defining a number of n selectable volumes, whereby choosing k equal to n−1, $V_k$ is a maximum volume $V_{n-1}$ and whereby choosing k equal to 0, $V_k$ is a minimum volume $V_0$, each of said n selectable volumes being obtainable by folding of wall means defining said container, said container comprising:

a bottom portion having two substantially parallel and opposing side edges each with a length dimension L and two substantially parallel and opposing end edges each with a width dimension W;

two side panels each having a height dimension H defined at side panel top edges, one of said two side panels attached along a side panel bottom edge to one of said bottom portion side edges, the other of said two side panels attached along a side panel bottom edge to the other of said bottom portion side edges, each of said side panels having n selectable side panel fold facilitating creases, a kth side panel fold facilitating crease being selected based upon said $V_k$, each of said n selectable side panel creases having a length substantially equal to said length L and substantially parallel to said side panel bottom edge;

two end panels each having said height dimension H defined at end panel top edges, one of said two end panels attached along an end panel bottom edge to one of said bottom portion end edges, the other of said two end panels attached along an end panel bottom edge to the other of said bottom portion end edges, each of said end panels having n selectable end panel fold facilitating creases, a kth end panel fold facilitating crease being selected based upon said $V_k$, each of said n selectable end panel creases having a length substantially equal to said width W and substantially parallel to said end panel bottom edge;

said two side panels, said two end panels and said bottom portion connected thereby forming said container;

lower-most side panel fold facilitating creases defined for k equal to 0 positioned on each of said side panels a lower-most crease distance of $H_0$ from each of said side panel bottom edges;

lower-most end panel fold facilitating creases defined for k equal to 0 positioned on each of said end panels a lower-most crease distance of $H_0$ from each of said end panel bottom edges;

top-most side panel fold facilitating creases defined for k equal to n−1 positioned on each of said side panels a top-most crease distance of $H_0$ plus n−1 times an incremental H, delta H, from each of said side panel bottom edges;

top-most end panel fold facilitating creases defined for k equal to n−1 positioned on each of said end panels a top-most crease distance of $H_0$ plus n−1 times said incremental H, said delta H, from each of said end panel bottom edges; and means for unconnecting said two side panels from said two end panels between at least said lowermost side panel fold facilitating creases and said lowermost end panel fold facilitating creases to about said side panel top edges and said end panel top edges, wherein said means for unconnecting comprises a pair of perforations parallel to the corners formed where said side panels meet said end panels, and wherein said pair of perforations comprises a first set of perforations and a second set of perforations, said first set spaced between about ⅛ inch to about ⅜ inch from said corners and substantially parallel with said corners on said end panel and said second set of perforations between about ⅛ inch to about ⅜ inch from said corners and substantially parallel with said corners on said side panel.

7. The container having a plurality of selectable volumes according to claim 6 wherein said delta H is equal to said H minus said $H_0$ minus one-half of said width W all divided by said integer n−1.

8. The container having a plurality of selectable volumes according to claim 6 further comprising:

side panel flaps attached along each of said side panel top edges having length substantially equal to said length L and a side panel flap width dimension substantially equal to not less than about one-half of said width W; and end panel flaps attached along each of said end panel top edges having length substantially equal to said width W and an end panel flap width dimension substantially equal to not less than about one-half of said width W.

9. The container having a plurality of selectable volumes according to claim 8 wherein said delta H is equal to said H minus said $H_0$ all divided by said integer n−1.

10. The container having a plurality of selectable volumes according to claim 9 wherein at least one set of each of said kth creases further comprises identifiable marking.

* * * * *